US009409060B2

(12) United States Patent
Ishii et al.

(10) Patent No.: US 9,409,060 B2
(45) Date of Patent: Aug. 9, 2016

(54) MULTILAYER SOLID GOLF BALL

(75) Inventors: Hideyuki Ishii, Portland, OR (US); Yutaka Kabeshita, Portland, OR (US); Hsin Cheng, Yun-lin Hsien (TW); Chien-Hsin Chou, Yun-lin Hsien (TW); Chen-Tai Liu, Yun-lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 982 days.

(21) Appl. No.: 13/404,687

(22) Filed: Feb. 24, 2012

(65) Prior Publication Data

US 2012/0214615 A1 Aug. 23, 2012

Related U.S. Application Data

(63) Continuation-in-part of application No. 12/230,272, filed on Aug. 27, 2008, now abandoned.

(51) Int. Cl.

| | |
|---|---|
| ***A63B 37/06*** | (2006.01) |
| ***A63B 37/00*** | (2006.01) |
| ***A63B 37/02*** | (2006.01) |

(52) U.S. Cl.

CPC ..... *A63B 37/0075* (2013.01); *A63B 37/0003* (2013.01); *A63B 37/004* (2013.01); *A63B 37/0039* (2013.01); *A63B 37/0045* (2013.01); *A63B 37/0051* (2013.01); *A63B 37/0061* (2013.01); *A63B 37/0062* (2013.01); *A63B 37/0064* (2013.01); *A63B 37/0076* (2013.01); *A63B 37/0078* (2013.01); *A63B 37/02* (2013.01)

(58) Field of Classification Search

CPC ..... A63B 37/0039; A63B 37/0059; A63B 37/0061

USPC ..... 473/376, 373, 374

See application file for complete search history.

(56) References Cited

U.S. PATENT DOCUMENTS

| | | | | |
|---|---|---|---|---|
| 6,183,382 | B1 * | 2/2001 | Kim et al. | 473/374 |
| 6,653,382 | B1 | 11/2003 | Statz et al. | |
| 7,009,002 | B2 | 3/2006 | Rajagopalan et al. | |
| 7,651,415 | B2 | 1/2010 | Ladd et al. | |
| 7,753,810 | B2 | 7/2010 | Sullivan et al. | |
| 2006/0172823 | A1 * | 8/2006 | Loper et al. | 473/371 |
| 2010/0056302 | A1 | 3/2010 | Cheng et al. | |
| 2012/0115637 | A1 | 5/2012 | Ishii et al. | |

* cited by examiner

*Primary Examiner* — Raeann Gorden

(74) *Attorney, Agent, or Firm* — Honigman Miller Schwartz and Cohn LLP

(57) ABSTRACT

A multilayer solid golf ball may include a core formed from a highly neutralized polymer and a cover surrounding the core. The ball may also include an enclosing layer disposed between the core and the cover, the enclosing layer having a thermal conductivity of 0.12 W/m-K or less.

16 Claims, 2 Drawing Sheets

MULTILAYER SOLID GOLF BALL

CROSS REFERENCE TO RELATED APPLICATIONS

This application is a continuation-in-part of U.S. patent application Ser. No. 12/230,272, filed Aug. 27, 2008(now abandoned), published as U.S. Patent Application Publ. No. 2010/0056302, entitled "Multilayer Solid Golf Ball," the entire disclosure of which is incorporated herein by reference.

TECHNICAL FIELD

The present invention relates to a golf ball and, more particularly, to a multilayer solid golf ball having an enclosing layer with a low thermal conductivity therein.

BACKGROUND OF THE INVENTION

A golfer typically selects a golf ball that has a combination of features based on his or her preferences and/or skill. Golf ball designers often attempt to provide a ball with characteristics that are balanced to suit a variety of golfer preferences and/or skill. Frequently, golf balls include a plurality of layers, with each layer helping to provide one or more desired qualities.

Flying distance is an important index by which a golf ball may be evaluated. The three main factors affecting flying distance of a golf ball are "initial velocity," "spin rate," and "launch angle." Initial velocity is one of the primary physical properties affecting the flying distance of a golf ball. The coefficient of restitution (COR) is an alternate parameter indicative of the initial velocity of a golf ball. Typically, the COR of a golf ball varies with temperature. Taking 24 degrees Celsius as the standard temperature, the physical properties, including the COR, of a golf ball will be affected when the temperature of the ball is lower than 24 degrees Celsius. The COR is typically significantly positive relative to the temperature, so the golf ball usually flies shorter in colder weather.

When playing golf in cold weather, 0 degrees Celsius for example, a golfer may utilize one or more techniques and, in some cases, heating devices to warm the ball. For example, in some cases, a golfer may use body temperature (for instance by putting the ball in their pocket or holding it in their hand) or a golf ball heater to raise the temperature of the golf ball in order to raise the COR of the golf ball thereby enabling the golfer to drive the ball farther. However, such warming techniques typically do not keep the temperature of the golf ball raised for a long time. Therefore, the raised COR of the golf ball cannot be kept elevated for a long time by using above-mentioned techniques. That is, the temperature will drop quickly when the ball leaves the golfer's body or the golf ball heater, and the temperature drop will result in an undesired deterioration of the COR of the ball, for example before the player has completed their round of golf. This often results in sudden changes of the COR that make it difficult for the golfer to predict and control the flying distance of the ball. Therefore, it would be desirable to reduce the effect of low temperature on the COR of a golf ball, and thus provide a ball that may maintain a desirable COR for a sustained amount of time in order to enable a golfer to complete a round or several holes without the COR dropping to undesired levels.

The present disclosure is directed to improvements in the consistency of golf ball performance characteristics across a broader range of playing conditions.

SUMMARY OF THE INVENTION

An objective of the present invention is to provide a multilayer solid golf ball, which has better properties with respect to flying distance and ball control in cold weather. To achieve this objective, an exemplary multilayer solid golf ball may include a core having a COR greater than 0.75 at a standard temperature of about 24 degrees Celsius, a cover surrounding the core, and an enclosing layer between the core and the cover. The enclosing layer may have a relatively low thermal conductivity, for example less than or equal to 0.2 W/m-K. Because of the relatively low thermal conductivity of the enclosing layer, it may limit the transfer of heat to and from the core. Thus, the enclosing layer may improve the sustainability of a desirable COR in cold weather conditions by limiting the deterioration in the COR of the ball under such conditions. This may maintain a desirable level of ball controllability as well as flying distance.

In one aspect, the present disclosure is directed to a multilayer solid golf ball. The ball may include a core formed from a highly neutralized polymer and a cover surrounding the core. The ball may also include an enclosing layer disposed between the core and the cover, the enclosing layer having a thermal conductivity of 0.12 W/m-K or less.

In another aspect, the present disclosure is directed to a multilayer solid golf ball. The ball may include a core having a coefficient of restitution greater than 0.75 at a temperature of 24° C., wherein the core is formed from a highly neutralized polymer and a cover surrounding the core. In addition, the ball may also include an insulating layer disposed between the core and the cover, and having a thermal conductivity that is lower than the thermal conductivity of the cover.

In another aspect, the present disclosure is directed to a multilayer solid golf ball. The ball may include a core having a coefficient of restitution greater than 0.75 at a temperature of 24° C. and having a Shore D hardness in the range of about 30 to 60. The ball may also include a cover surrounding the core. In addition the ball may include an enclosing layer disposed between the core and the cover, the enclosing layer having a thermal conductivity of 0.12 W/m-K or less.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
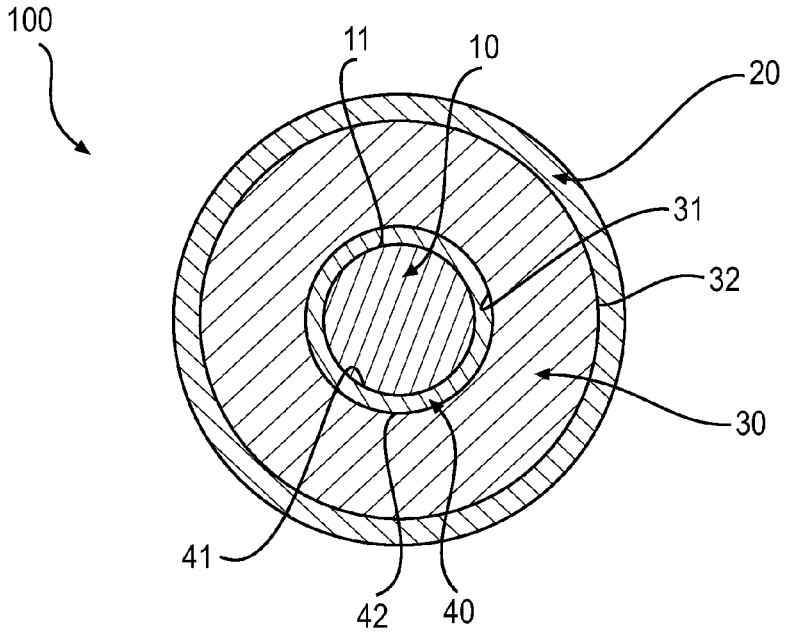
FIG. 1 shows a cross-sectional view of an exemplary golf ball in accordance with this disclosure, the golf ball being of a four-piece construction.

The present disclosure is directed to a golf ball formed of materials and layers with certain performance characteristics.

The following paragraphs explain the measurement processes for several characteristics.

For purposes of this disclosure, the term "compression deformation" refers to the amount deformation exhibited by an object when compressed under a predetermined set of loading parameters. As used in the present disclosure, compression deformation shall refer to the deformation amount (in millimeters) of an object when compressed by a force, specifically, the deformation of the object when the compression force is increased from 10 kg to 130 kg. The deformation amount of the object under the force of 10 kg is subtracted from the deformation amount of the object under the force of 130 kg to obtain the compression deformation value of the object. While compression deformation is a parameter that may be measured for entire golf balls, compression deformation can also be measured for individual components of golf balls. In the present disclosure, compression deformation of a golf ball inner core layer, which, like the entire golf ball, may also be spherical, is measured and discussed in detail.

Hardness of a golf ball layer is measured generally in accordance with ASTM D-2240. In some cases the hardness may be measured on a cross-sectional surface of a ball layer. In other cases, the hardness may be measured on the curved surface of a ball layer. When measuring the hardness of a golf ball as a whole the measurement is taken on the land area of the outer surface of the ball.

Flexural modulus of a golf ball material is measured in accordance with ASTM D-790.

Coefficient of restitution (COR), as referred to in the present disclosure, is measured in the following manner. To measure COR, a golf ball is fired by an air cannon, or other propulsion device, at an initial velocity of 40 m/sec toward a steel plate located about 1.2 meters away from the cannon. A speed monitoring device is located at a distance of 0.6 to 0.9 meters from the cannon. The speed monitoring device measures the speed of the golf ball after bouncing off the steel plate. The return velocity divided by the initial velocity is the COR.

For the purposes of this disclosure, the term "thermoplastic" refers to the conventional meaning of the term thermoplastic, i.e., a material, such as a high polymer, that softens when exposed to heat.

For the purposes of this disclosure, the term "thermoset" refers to the conventional meaning of the term thermoset, i.e., a composition, compound, material, medium, substance, etc., that is cross-linked such that it does not have a melting temperature, and cannot be dissolved in a solvent, but which may be swelled by a solvent.

For the purposes of this disclosure, the term "polymer" refers to a molecule having more than 30 monomer units, and which may be formed or result from the polymerization of one or more monomers or oligomers.

For the purposes of this disclosure, the term "oligomer" refers to a molecule having 2 to 30 monomer units.

For the purposes of this disclosure, the term "monomer" refers to a molecule having one or more functional groups and which is capable of forming an oligomer and/or polymer.

For the purposes of this disclosure, the term "ionomer" or "ionomer resin" refers to an oligomer or a polymer having at least one carboxylic acid group neutralized by one or more bases (including mixtures of bases) to provide carboxylic acid salt monomer units (or mixtures of carboxylic acid salt monomer units). For example, the ionomer may comprise a mixture of carboxylic acid sodium and zinc salts monomer units, such as the mixed salts of ionomer resins sold under DuPont's trademark SURLYN® for cut-resistant golf ball covers.

An ionomer resin may be a copolymer of one or more carboxylic acids (such as methacrylic acid) and one or more monomers which are not carboxylic acids, such as, for example, ethylene.

For the purposes of this disclosure, the term highly neutralized polymer refers to polymers whose carboxylic acid groups have been mostly neutralized by the addition of a counter-ion material. Highly neutralized polymers may be neutralized 95% or greater.

For the purposes of this disclosure, the term "elastomer" refers to oligomers or polymers having the property of elasticity.

For the purposes of this disclosure, the term "polyisocyanate" refers to an organic molecule having two or more isocyanate functional groups (e.g., a diisocyanate). Polyisocyanates useful herein may be aliphatic or aromatic, or a combination of aromatic and aliphatic, and may include, but are not limited to, diphenyl methane diisocyanate (MDI), toluene diisocyanate (TDI), hexamethylene diisocyanate (HDI), dicyclohexylmethane diisocyanate (H12MDI), isophorone diisocyanate (IPDI), etc.

For the purposes of this disclosure, the term "polyol" refers to an organic molecule having two or more hydroxy functional groups. The term "polyol" may include diols, triols, etc., polyester polyols, polyether polyols, polycarbonate diols, etc. For example, these other polyols may include "bio-renewable" polyether polyols (i.e., those polyether polyols which have reduced impact on the environment during processing) such as one or more of polytrimethylene ether glycol, polytetramethylene ether glycol (PTMEG), etc., which have, for example, a hydroxyl value of 11.22 to 224.11 mg KOH/g. These "bio-renewable" polyether polyols, such as polytrimethylene ether glycols, may be derived, obtained, extracted, etc., from bio-renewable resources rather by a synthetic chemical process.

For the purposes of this disclosure, the term "polyurethane" refers to a polymer which is joined by urethane (carbamate) linkages and which may be prepared, for example, from polyols (or compounds forming polyols such as by ring-opening) and polyisocyanates. Polyurethanes useful herein may be thermoplastic or thermosetting, but are thermoplastic when used in the cover. The soft segment of a thermoplastic polyurethane may also be partially cross-linked with other polyols or materials to achieve varying properties or characteristics, such as to manipulate the hardness, etc.

For the purposes of this disclosure, the term "chain extender" refers to an agent which increases the molecular weight of a lower molecular weight polyurethane to a higher molecular polyurethane. Chain extenders may include one or more diols such as ethylene glycol, diethylene glycol, butanediol, hexanediol etc.; triols such as trimethylolpropane, glycerol, etc.; and polytetramethylene ether glycol, etc.

The present disclosure is directed to golf ball layers having certain performance characteristics. These characteristics may be achieved due to the structural configuration of the layers and/or the material compositions of the layers. Further, the overall performance characteristics of the golf ball are affected in certain ways by the makeup of individual layers and also reflect the combination and arrangement of the layers and materials from which the golf ball is formed. Accordingly, the dimensions and materials of each layer may be selected to achieve desired performance characteristics.

The concepts discussed in the present disclosure may be applicable to golf balls having any construction, having any suitable number of layers. In some embodiments, an exemplary golf ball having the disclosed performance characteristics may have a four-piece or four-layer construction. In other embodiments, the ball may have a five-piece construction. In addition, other configurations are envisioned that include six or more layers.

Further, although the disclosure describes various embodiments relating to golf balls, a person having ordinary skill in the art will be able to adapt the disclosed concepts for use in other types of balls (other than golf balls) and for use in other types of layered articles. For example, the disclosed concepts may be applicable to any layered article, such as a projectile, ball, recreational device, or individual components of these articles.

In accordance with the present disclosure, a golf ball may include provisions to limit the deterioration of the COR of the ball's core in cold weather. For example, in some embodiments, an exemplary golf ball may include an insulating layer enclosing the core. The insulating layer (or enclosing layer) may have a relatively low thermal conductivity in order to limit heat transfer between the core and the atmospheric environment. That is, the insulating layer may limit the conduction of heat from the core to other portions of the ball and, ultimately, to the atmospheric air. With such an insulating layer, the core may take a longer time to cool down in cold weather, and thus, may maintain a higher COR.

As shown in FIG. 1, a multilayer solid golf ball 100 may include a core 10, a cover 20, an intermediate layer 30, and an enclosing layer 40. As shown in FIG. 1, in some embodiments, ball 100 may have a four-piece construction. The disclosed concepts may be applicable to four-piece golf balls, such as ball 100, as well as balls having other configurations, such as five-piece constructions, six-piece constructions, or constructions having any suitable number of pieces, including embodiments having more than six layers.

In some embodiments, golf ball 100 may have a diameter of at least 42.67 mm (1.680 inches), in accordance with the Rules of Golf. For example, in some embodiments, golf ball 100 may have a ball diameter between about 42.67 mm and about 42.9 mm, and may, in some embodiments, have a ball diameter of about 42.7 mm. Golf ball 100 may have a ball weight between about 45 g and about 45.8 g and may, in some embodiments, have a ball weight of about 45.4 g. The golf ball may be 'conforming,' i.e., in conformance with the USGA rules about golf balls, including weight, diameter, initial velocity, and the like, or it may be 'non-conforming.' The specifications set forth in this paragraph may be applicable to all golf ball embodiments described in the present disclosure.

Core

Core 10 may be disposed at the most central portion of ball 100. Accordingly, core 10 may be spherical with an outer surface 11. In some cases, such a component may be referred to as a central core, inner core, or inner core layer. In addition, although core 10 is shown and discussed in the present disclosure as having a single layer construction, in some embodiments, core 10 may have a multilayer construction.

Core 10 may be made, for example, by hot-press molding or injection molding. In some embodiments, injection molding may be preferred. During an exemplary injection molding process of forming core 10, the temperature of the injection machine may be set in a range of approximately 190° C. to 220° C.

Core Dimensions

Core 10 may have a diameter in a range between 19 mm and 37 mm, with a preferred diameter range of between 21 mm and 35 mm, more typically between approximately 24 mm and approximately 28 mm. In some embodiments, core 10 may have a diameter of approximately 24.5 mm (for example, 24.5+/−0.15). In some embodiments, core 10 may have a diameter of 24.5 mm.

Core Properties

As noted above, the COR of a golf ball is a significant factor contributing to the flying distance of the ball. COR is a ratio of the speed of the ball after a collision of particular conditions to the speed of the ball before the collision. Thus, the COR of a ball is a value that quantifies the elasticity of the ball during collisions between the ball and other objects, such as a golf club. The higher the COR, the faster the initial velocity of the ball will be coming off the clubface. In some embodiments, core 10 may have a COR greater than 0.75, preferably greater than 0.77, more preferably greater than 0.79, and most preferably greater than 0.8.

Golf ball 100, as a whole, may have a COR of approximately 0.776. For example, in some embodiments, ball 100 may have a COR of 0.776+/−0.004. In some embodiments, ball 100 may have a COR of 0.776.

In addition to COR, other properties may be desirable for the core. For example, it may be desirable for the core to have a certain hardness and/or specific gravity.

In some embodiments, core 10 may have a surface Shore D hardness in the range of about 30 to 60, preferably in the range of about 45 to 55. In some embodiments, core 10 may have a surface shore D hardness of approximately 50 (for example 50+/−2). In some embodiments, core 10 may have a surface shore D hardness of 50. To provide golf ball 100 with stable performance, core 10 may have a Shore D cross-sectional hardness of from 45 to 55 at any single point on a cross-section obtained by cutting core 10 in half. Further, core 10 may have a Shore D cross-sectional hardness difference between any two points on the cross-section of within +/−6 and, in some embodiments, the difference between any two points on the cross-section may be within +/−3.

Certain attributes of the golf ball, such as moment of inertia, may be determined, in part, by the comparative physical properties of the different layers of the golf ball. For example, in some embodiments, a greater moment of inertia may be achieved by forming layers disposed radially outward from the center of the ball with a higher specific gravity, and by forming layers disposed radially inward toward the center of the ball with a relatively lower specific gravity. A golf ball with a greater moment of inertia may maintain its rate of spin for longer than a golf ball with a lower moment of inertia. This may provide a ball with improved short game characteristics, as spin enables a player to hit a ball near the hole with limited roll beyond the point of impact and, in some cases, even roll backward after landing. Spin may also contribute to longer drives, as the trajectory will not drop off as steeply as the ball starts coming back down after reaching its apex.

In some embodiments, it may be desirable for golf ball 100 to have a moment of inertia between about 82 g-cm$^2$ and about 90 g-cm$^2$. Such a moment of inertia may produce desirable distance, trajectory, and control. Such a moment of inertial may produce desirable performance characteristics, for example, when golf ball 100 is struck with a driver and/or is flying against the wind. To provide golf ball 100 with a greater moment of inertia, core 10 may have a lower specific gravity than outer layers. In some embodiments, the specific gravity of core 10 may be in the range of about 0.9 g/cm$^3$ to about 1.1 g/cm$^3$. For example, in some embodiments, the specific gravity of core 10 may be approximately 1.07 (for example 1.07+/−0.02). In some embodiments, the specific gravity of core 10 may be 1.07.

Another parameter that can have an affect on the performance of the ball is the compression deformation. Compression deformation is a physical parameter that may be quantified (in millimeters for example) according to the measurement protocol set forth above. A higher compression deformation value indicates that the ball deforms more when subjected to a given compressive force. That is, a ball having a higher compression deformation is more compressible than a ball having a lower compression deformation. In some embodiments, core 10 may have a compression deformation value in a range of about 2 mm to about 5 mm at 24° C. In some embodiments, core 10 may have a compression deformation value in the range from about 3 mm to about 5 mm.

Core Materials

The core and other components of the golf ball may be formed from any materials suitable for providing the component and the ball as a whole with the desired properties and performance characteristics. Exemplary such materials are described below. In addition, exemplary suitable materials are also discussed in U.S. Patent Publication No. 2012-0115637, the entire disclosure of which is incorporated herein by reference.

Core 10 may be formed of a relatively firm material in order to provide a long flying distance. In some embodiments, the core 10 may be made from a thermoplastic or thermosetting material, with a thermoplastic material preferred. When the core 10 is made from a thermoplastic composition, the thermoplastic composition may have a flexural modulus in a range of from 5 kpsi to 70 kpsi, preferably from 5 kpsi to 60 kpsi, more preferably from 5 kpsi to 50 kpsi and most preferably from 5 kpsi to 45 kpsi. The thermoplastic material of core 10 may include an ionomer resin, polyamide resin, polyester resin, polyurethane resin, or a mixture of these or other such resins.

In some embodiments, an ionomer resin may be preferred for core 10. For example, in some embodiments, core 10 may be formed, at least in part, from a highly neutralized polymer. The polymer may be neutralized to 70 percent or higher, including up to 100 percent, with a suitable cation source, such as magnesium, sodium, zinc, or potassium. In some embodiments, the polymer may preferably be neutralized to 80 percent or higher. Suitable highly neutralized polymers for use in forming core 10 may include a highly neutralized polymer and optionally additives, fillers, and/or melt flow modifiers. Suitable highly neutralized polymer compositions include salts of homopolymers and copolymers of α,β-ethylenically unsaturated mono- or dicarboxylic acids, and combinations thereof, optionally including a softening monomer.

Suitable highly neutralized polymer compositions may include HPF resins such as HPF1000, HPF2000, HPF AD1027, HPF AD1035, HPF AD1040, and mixtures thereof, all produced by E. I. Dupont de Nemours and Company. Suitable highly neutralized polymer compositions for use in forming an inner core may comprise a highly neutralized polymer composition and optionally additives, fillers, and/or melt flow modifiers.

Suitable additives and fillers include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., core material that is ground and recycled; and nano-fillers.

Any suitable melt flow modifiers may be included in the highly neutralized polymer. Exemplary suitable melt flow modifiers may include, for example, fatty acids and salts thereof, polyamides, polyesters, polyacrylates, polyurethanes, polyethers, polyureas, polyhydric alcohols, and combinations thereof.

The highly neutralized polymer may also be mixed with conventional ionomers including, for example, Surlyn®, commercially available from E. I. Dupont de Nemous and Company, or IOTEK®, commercially available from Exxon Corporation. To achieve the desired COR, a main composition of the core 10 is preferably HPF, and Surlyn® and/or IOTEK® are sub-compositions which are optionally added therein. The sub-composition of core 10 is in an amount of 0 to 10 parts by weight, based on 100 parts by weight of the main composition of the core 10.

In addition, or as an alternative, to one or more of the materials discussed above, any other suitable materials may be also used to make the core 10. A skilled artisan may recognize other suitable materials for providing core 10 with the desired properties and performance characteristics.

Cover

The outer surface of cover 20 may have a plurality of dimples configured to provide a desired aerodynamic effect. The dimples may be arranged in any suitable dimple pattern. In some embodiments, golf ball 100 may be provided with a dimple pattern including a total number of dimples between approximately 300 and 400. For example, in some embodiments, ball 100 may have 360 dimples.

Cover Dimensions

The thickness of the cover 20 may be in a range of from 0.5 mm to 2.5 mm, or in a range of from 0.8 mm to 2 mm, or in a range of from 1 mm to 2 mm. Cover 20 may include one or more layers, and may also have one or more finish coatings applied to its outer surface.

Cover Properties

Cover 20 may be formed of a relatively soft but durable material. For example, cover 20 may be formed of a material that compresses/flexes when struck by a golf club, in order to provide spin of the ball and feel to the player. Although relatively soft, the material may also be durable, in order to withstand scuffing from the club and/or the golf course. Exemplary cover layer materials may include urethane, ionomer blends, or any other suitable material, including blends. In addition, in some embodiments, cover 20 may include one or more cross-linking agents.

Cover 20 has a Shore D hardness of from 25 to 80. In some embodiments, the Shore D hardness of cover 20 is higher than that of core 10 and in some embodiments, the Shore D hardness of cover 20 is higher than that of core 10 by at least 10 points. In some embodiments, the Shore D hardness of core 10 is higher than that of cover 20 and in some embodiments, the Shore D hardness of core 10 is higher than that of cover 20 by at least 5 points. In some embodiments, cover 20 may have a surface Shore D hardness of approximately 54 to 61. In some embodiments, cover 20 may have a Shore D hardness of approximately 56 (for example 56+/−2). In some embodiments, cover 20 may have a Shore D hardness of 56.

Cover Materials

Any suitable thermoplastic or thermoset material may be used to make cover 20. In some embodiments, cover 20 may be made from a thermoplastic material comprising at least one of an ionomer resin, a highly neutralized polymer composition, a polyamide resin, a polyester resin, a polyurethane resin, and a combination thereof. In the present embodiment, ionomer resin, polyurethane resin, or highly neutralized polymer composition is preferred for cover 20. In some embodiments, cover 20 is made from a thermoset material comprising at least one of polyurethane elastomers, polyamide elastomers, polyurea elastomers, diene-containing polymer, crosslinked metallocene catalyzed polyolefin, silicone, and a combination thereof. Among these thermoset materials, thermoset polyurethane elastomers are popular. When cover 20 is made from a thermoplastic material, the thermoplastic composition has a flexural modulus in a range of from 0.3 kpsi to 70 kpsi, or from 0.5 kpsi to 60 kpsi, or from 1 kpsi to 50 kpsi, or from 1 kpsi to 40 kpsi. In some embodiments, cover 20 has a flexural modulus higher than that of core 10 and in some embodiments, cover 20 has a flexural modulus higher than that of core 10 by at least 10 kpsi. In some embodiments, core 10 has a flexural modulus higher than that of cover 20 and in some embodiments, core 10 has a flexural modulus higher than that of cover 20 by at least 5 kpsi.

Intermediate Layer

Intermediate layer 30 may have an inner surface 31 and an outer surface 32. In some embodiments, inner surface 31 may face enclosing layer 40 and outer surface 32 may face cover 20, as shown in FIG. 1. In some cases, intermediate layer 30 may be referred to as an outer core, outer core layer, or mantle layer.

Intermediate Layer Dimensions

The thickness of the intermediate layer 30 may be in a range between 2 mm and 11 mm, or in a range of 2.1 mm and 9.5 mm, or in a range between 3.6 mm and 8.5 mm. Intermediate layer 30 is preferably made by hot-press molding. Suitable vulcanization conditions include a vulcanization temperature of between 130 degrees Celsius and 190 degrees Celsius, and a vulcanization time of between 5 and 20 minutes. To obtain the desired rubber crosslinked body for use as intermediate layer 30 in the present invention, the vulcanizing temperature is preferably at least 140 degrees Celsius.

Intermediate Layer Properties

Intermediate layer 30, may have a compression deformation value in a range of from 2.5 mm to 4.5 mm. In some embodiments, intermediate layer 30 may have a compression deformation of approximately 3.05 (for example, 3.05+/−0.25). In some embodiments, intermediate layer 30 may have a compression deformation of 3.05. In some embodiments, the compression deformation value of intermediate layer 30 may be higher (i.e. more deformation) than the compression deformation value of core 10. In some embodiments, the compression value of the intermediate layer 30 may be lower (i.e. less deformation) than core 10. In some embodiments, the compression deformation of the combined structure of intermediate layer 30, core 10, and enclosing layer 40 may be approximately 3.2-3.3 mm.

Intermediate layer 30 may have a Shore D hardness in the range of 35 to 65. In some embodiments, Intermediate layer 30 may have a Shore D hardness of approximately 60 (for example 60+/−2). In some embodiments, intermediate layer 30 may have a Shore D hardness of 60. In some embodiments, the Shore D hardness of intermediate layer 30 may be lower than that of the core 10. In some embodiments, the Shore D hardness of intermediate layer 30 may be higher than that of the core 10.

Intermediate Layer Materials

Intermediate layer 30 may be formed of a relatively firm and suitably resilient material. Intermediate layer 30 may be configured to provide a relatively high launch and a relatively low spin rate when the ball is struck by a driver, and a relatively higher spin rate and increased control when struck with irons. This may provide distance off the tee and control around the greens.

Intermediate layer 30 may be made from a thermoplastic material or a thermosetting material. For example, in some embodiments, intermediate layer 30 may comprise material selected from the following groups: (1) thermoplastic materials selected from the group consisting of ionomer resin, highly neutralized polymer composition, polyamide resin, polyester resin, polyurethane resin and a mixture thereof; or (2) thermoset materials selected from the group consisting of polyurethane elastomer, polyamide elastomer, polyurea elastomer, diene-containing polymer (such as polybutadiene), crosslinked metallocene catalyzed polyolefin, silicone, and mixtures thereof.

An intermediate layer made from thermoset materials may be made by crosslinking a polybutadiene rubber composition. When other rubber is used in combination with a polybutadiene, it is typical that polybutadiene is included as a principal component. Specifically, a proportion of polybutadiene in the entire base rubber is preferably equal to or greater than 50% by weight, and particularly preferably equal to or greater than 80% by weight.

Exemplary base rubbers that may be used in the rubber composition include 1,4-cis-polybutadiene, polyisoprene, styrene-butadiene copolymers, natural rubber, and a mixture thereof. To have a better resilient performance, 1,4-cis-polybutadiene is preferred. Alternatively, cis-1,4-polybutadiene can be used as the base material for the intermediate layer 30 and mixed with other ingredients. However, the amount of cis-1,4-polybutadiene should be at least 50 parts by weight, based on 100 parts by weight of the rubber composition. A polybutadiene having a proportion of cis-1,4 bonds of equal to or greater than 60 mol %, and further, equal to or greater than 80 mol % is typical. In some embodiments, cis-1,4-polybutadiene may be used as the base rubber and mixed with other ingredients.

In some embodiments, a polybutadiene synthesized using a rare earth element catalyst may be used. Excellent resilience performance of a golf ball may be achieved by using this polybutadiene. Examples of rare earth element catalysts include lanthanum series rare earth element compounds. Other catalysts may include an organoaluminum compound, and alumoxane and halogen containing compounds. A lanthanum series rare earth element compound is typical. Polybutadiene obtained by using lanthanum series rare earth-based catalysts usually employ a combination of lanthanum series rare earth (atomic number of 57 to 71) compounds, but particularly typical is a neodymium compound.

Various additives may be added to the base rubber to form a compound. The additives may include a cross-linking agent and a filler. In some embodiments, the cross-linking agent may be zinc diacrylate, magnesium acrylate, zinc methacrylate, or magnesium methacrylate. In some embodiments, zinc diacrylate may provide advantageous resilience properties. The filler may be used to increase the specific gravity of the material. The filler may include zinc oxide, barium sulfate, calcium carbonate, or magnesium carbonate. In some embodiments, zinc oxide may be selected for its advantageous properties. Metal powder, such as tungsten, may alternatively be used as a filler to achieve a desired specific gravity. In some embodiments, the density of an intermediate layer may be from about 1.05 g/cm$^3$ to about 1.25 g/cm$^3$.

Enclosing Layer

Enclosing layer 40 may surround core layer 10. It should be noted that any layer may surround or substantially surround any layers disposed radially inward of that layer. For example, cover 20 may surround or substantially surround intermediate layer 30.

Enclosing layer 40 may serve as an insulating layer configured to limit cooling of core 10 in cold weather. In some embodiments, enclosing layer 40 may be located between core 10 and intermediate layer 30, as shown in FIG. 1. The extent to which enclosing layer 40 limits heat transfer from core 10 is dependent on the thickness of enclosing layer 40 and the thermal conductivity of the enclosing layer 40.

Enclosing Layer Dimensions

To maintain the COR of ball 100, the thickness of the enclosing layer 40 may be less than or equal to 1 mm, or in a range between 0.005 mm and 0.70 mm, or in a range between 0.01 mm and 0.4 mm. If the thickness of the enclosing layer 40 is less than 0.005 mm, the low thermal conductivity effect of the enclosing layer 40 is not significant. In the present embodiment, the enclosing layer 40 directly covers the outer surface 11 of the core 10. In other words, the enclosing layer 40 has an inner surface 41 contacting the outer surface 11 of core 10 and an outer surface 42 contacting the inner surface 31 of the intermediate layer 30.

Enclosing Layer Properties

In order to limit transfer of heat from core 10, enclosing layer 40 may be made from a material with a relatively low thermal conductivity. In some embodiments, the thermal conductivity of enclosing layer 40 may be lower than the thermal conductivity of cover 20 and/or lower than the thermal conductivity of intermediate layer 30. In some embodiments, the thermal conductivity of enclosing layer 40 may be less than or equal to 0.2 W/m-K so that the enclosing layer 40 will have a superior performance in reducing the conductivity of the cold from cover 20 to core 10. In some embodiments, the thermal conductivity of enclosing layer 40 is preferably between 0.04 W/m-K and 0.15 W/m-K, and more preferably between 0.06 W/m-K and 0.15 W/m-K.

Enclosing Layer Materials

In some embodiments, the material of enclosing layer 40 may comprise at least one of ethylene vinyl acetate copolymer (EVA), polyurethane, polyester, polyamide, polyisoprene, polyvinyl chloride (PVC), acrylonitrile butadiene styrene copolymer, polyvinylidene fluoride, polyimide, and combinations thereof. Those having ordinary skill in the art will recognize other materials having the properties desired for enclosing layer 40, such as a relatively low thermal conductivity.

In some embodiments, enclosing layer 40 may have a non-homogeneous structure. For example, in some embodiments, enclosing layer 40 may include particles embedded in a main layer material. The particles may have different properties than the main layer material and may be distributed throughout the enclosing layer to provide the layer, as a whole, with certain desired characteristics. In other embodiments, enclosing layer 40 may be formed of a substantially homogeneous material. That is, enclosing layer 40 may be comprised of a material or materials that are uniformly mixed to create a homogeneous composition. In some embodiments, a homogeneous enclosing layer formed of a material having a relatively low thermal conductivity may provide more restriction to heat transfer than, for example, a layer including embedded particles having a low thermal conductivity. Embedded particles may not provide a fully encapsulating barrier to heat transfer in the same way that a homogeneous layer of material having a low thermal conductivity.

Alternative Enclosing Layer Configuration

Although the enclosing layer 40 is disposed immediately adjacent inner core 10 in the embodiment shown in FIG. 1, the enclosing layer may be disposed in any suitable location between core 10 and cover 20. For example, while the enclosing layer may, in some embodiments, be disposed radially inward of intermediate layer 30, as shown in FIG. 1, in other embodiments, the enclosing layer may be disposed radially outward of the intermediate layer, as shown in FIG. 2.

Figure 2:
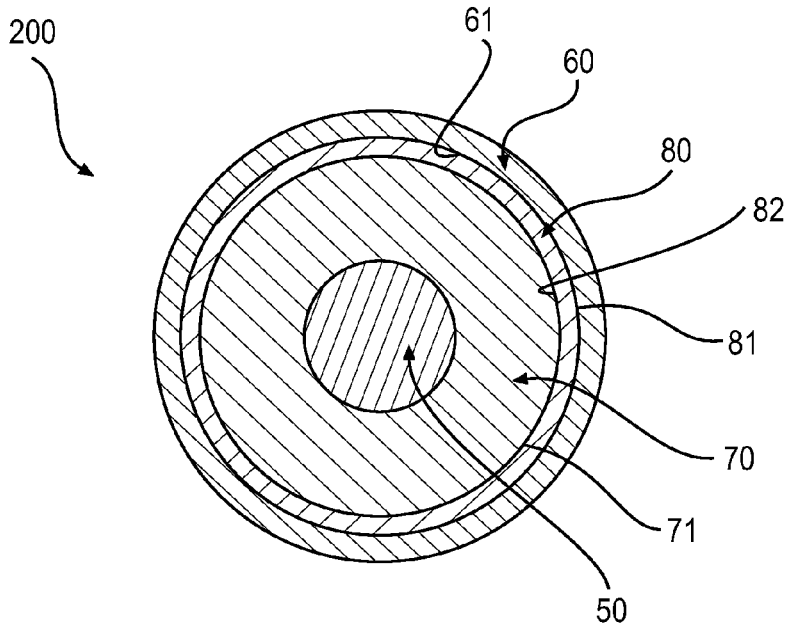
FIG. 2 shows a cross-sectional view of an alternative golf ball having a four-piece construction.

FIG. 2 shows a multilayer solid golf ball 200 according to a second embodiment, in which an alternate enclosing layer 80 is provided. Similar to ball 100 of the first preferred embodiment, ball 200 may include a core 50, a cover 60, an intermediate layer 70, and enclosing layer 80. As shown in FIG. 2, enclosing layer 80 may be disposed between intermediate layer 70 and cover 60. The enclosing layer 80 may have an inner surface 82 contacting an outer surface 71 of intermediate layer 70 and an outer surface 81 contacting an inner surface 61 of cover 60.

The components of ball 200 may have substantially similar characteristics with corresponding components of ball 100. Accordingly, the descriptions of the components of ball 100 above may be applicable to the components of ball 200 as well.

In some embodiments, the dimensions and/or materials used for certain components may vary with the placement of the components in order to achieve the same properties and performance characteristics. For example, in some embodiments, enclosing layer 80 may have a thickness that is slightly less than enclosing layer 40 due to its placement radially outward of intermediate layer 30 rather than radially inward of intermediate layer 30. An enclosing layer that is located further radially outward will comprise more material than an inwardly disposed enclosing layer of the same thickness. Thus, the same amount of insulating material may be provided in an outwardly disposed insulating layer having a smaller thickness. This may provide a ball designer with more flexibility to modify the dimensions of other components to achieve desired performance characteristics. On the other hand, an outwardly disposed insulating layer will also have a greater surface area that may be exposed to the cold, which may dictate that the insulating layer be the same or greater thickness as an inwardly disposed insulating layer. Those having ordinary skill in the art will be able to determine appropriate changes to golf ball components to achieve similar performance characteristics for balls having the insulating layers in different locations.

Mantle Layer

In some embodiments, at least one additional layer may be added to the golf ball. For example, in some embodiments, a mantle layer may be added between cover 20 and intermediate layer 30. Other layers may be added on either side of any disclosed layer as desired to achieve certain performance characteristics and/or attributes.

Figure 3:
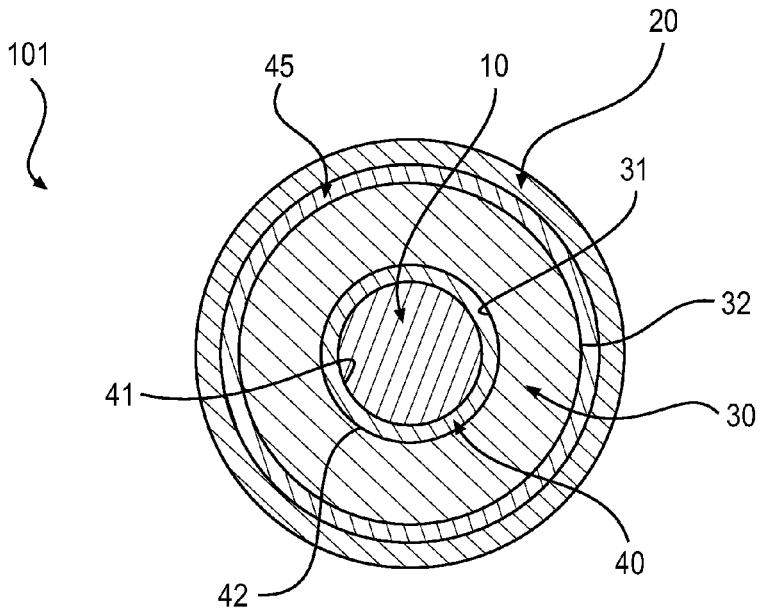
FIG. 3 shows a cross-sectional view of an exemplary golf ball in accordance with this disclosure, the golf ball being of a five-piece construction including a mantle layer.

FIG. 3 illustrates a ball 101 having a similar construction and components to ball 100. As shown in FIG. 3, ball 101 may further include a mantle layer 45. Mantle layer 45 may abut cover 20, as shown in FIG. 3. Though referred to herein as a "mantle layer," some of those in the art may refer to mantle layer 45 by other names, such as "inner cover layer." Regardless of the naming convention used, any layer positioned next to the outer cover, such as cover 20, may be considered a mantle layer. As shown in FIG. 3, in some embodiments, mantle layer 45 may be disposed radially outward of intermediate layer 30 and radially inward of cover 20.

Mantle Dimensions

In some embodiments, mantle layer 45 may be thinner than cover 20. The thickness of mantle layer 45 may be any thickness less than that of cover 20. In some embodiments, the thickness of mantle layer 45 may be less than 1.2 mm. For example, in some embodiments, the thickness of mantle layer 45 may be about 0.9 mm. In some embodiments, the thickness of mantle layer 45 may be about 0.6 mm. In some embodiments, the thickness of mantle layer 45 may be approximately half of the thickness of cover 20. In some embodiments, the thickness of mantle layer 45 may be at least 0.3 mm less than the thickness of cover 20.

Mantle layer 45 may, in some embodiments, be the thinnest layer, or one of the thinnest layers, in golf ball 101. One way to characterize the size of mantle layer 45 is by the volume of the layer as a percentage of the total volume of golf ball 101. The total volume of golf ball 101 may be considered to be the sum of the volumes of each of the layers of golf ball 101. For example, because golf ball 101 comprises core 10, enclosing layer 40, intermediate layer 30, mantle layer 45, and cover 20, the total volume of golf ball 101 is the sum of the core volume, the enclosing layer volume, the intermediate layer volume, the mantle layer volume, and the cover volume. Because each layer of the golf ball is spherical or a portion of a spherical body, the volume of any layer can be calculated as the volume of a sphere having a diameter of the thickness of the layer or a portion of a sphere volume having a height of the thickness of the layer.

In some embodiments of golf ball 101, mantle layer 45 may have a volume that is 10 percent or less of the total volume of golf ball 101. In some embodiments where the thickness of mantle layer 45 is about 0.8 mm, mantle layer 45 may have a volume that is about 9.8 percent of the total volume of golf ball 101. In some embodiments where the thickness of mantle layer 45 is about 0.6 mm, mantle layer 45 may have a volume that is about 7.44 percent of the total volume of golf ball 101.

Mantle Layer Properties

In some embodiments, the mantle layer may be harder than the cover of a golf ball. For example, in some embodiments, mantle layer 45 may have a higher hardness than cover 20 of ball 101. In some embodiments, mantle layer 45 may have a Shore D hardness of greater than about 60 while the cover 20 may have a Shore D hardness of less than about 60. In some embodiments, mantle layer 45 may have a hardness of between about 62-70, while cover 20 may have a Shore D hardness of from about 45-58 as measured on the ball. In some embodiments, the hardness difference between mantle layer 45 and cover 20 may be at least about 4 Shore D units, where mantle layer 45 is harder than cover 20. Providing a softer cover 20 and a relatively hard mantle layer 45 may reduce the spin off of driver shots due to the hard mantle layer 45 while allowing iron shots to attain high or desired spin rates due to the soft cover 20.

In some embodiments, mantle layer 45 and cover 20 may have a similar specific gravity. In some embodiments, the specific gravity of mantle layer 45 and cover 20 may be about 1.2. In some embodiments, mantle layer 45 may have a specific gravity of about 1.160 (for example 1.160+/−0.005) and cover 20 may have a specific gravity of about 1.150 (for example 1.150+/−0.02). In some embodiments, mantle layer 45 may have a specific gravity of 1.160.

Mantle Layer Materials

Mantle layer 45 may be formed of any suitable material with which the properties discussed above may be achieved. In some embodiments, mantle layer 45 may be urethane or urethane based.

Alternative Mantle Layer Configuration

Figure 4:
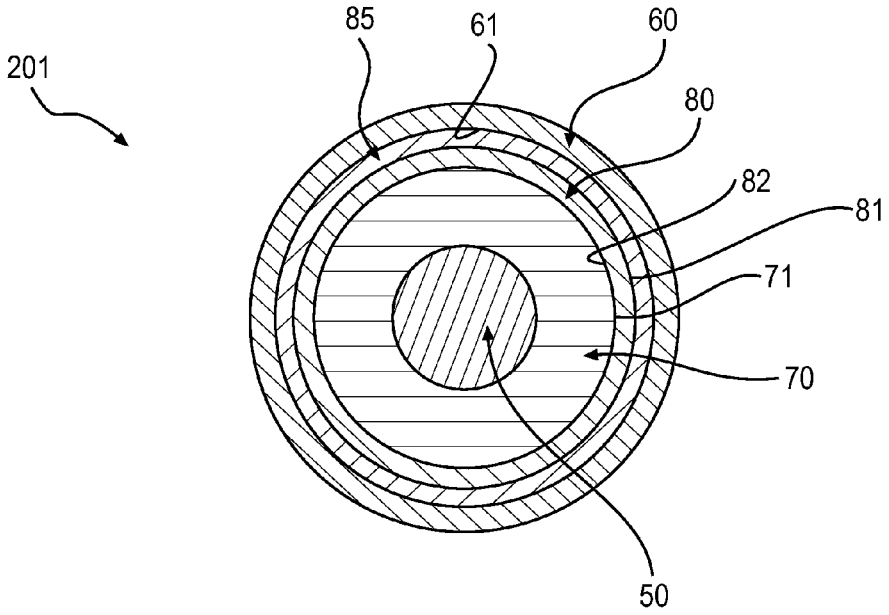
FIG. 4 shows a cross-sectional view of an alternative golf ball in accordance with this disclosure, the golf ball being of a five-piece construction including a mantle layer.

FIG. 4 shows a ball 201 having a structural configuration similar to ball 200 in FIG. 2. Accordingly, components of ball 201 may have dimensions, properties, and/or characteristics that are the same or substantially similar to corresponding components of ball 200, which, as discussed above, may be substantially similar to the components of FIG. 1. In ball 201, like ball 200 in FIG. 2, the enclosing layer 80 is disposed radially outward of intermediate layer 70, as shown in FIG. 4. In addition, as also shown in FIG. 4, ball 201 may further include a mantle layer 85. Mantle layer 85 may be disposed between enclosing layer 80 and cover 60. That is, mantle layer 85 may be disposed radially outward of enclosing layer 80 and radially inward of cover 60, as shown in FIG. 4. Mantle layer 85 may have the same or substantially similar dimensions (thickness), properties, and characteristics as mantle layer 45 discussed above, with adjustments made to accommodate its more radially outward location.

EXAMPLES

Tables 1 to 5 below illustrate exemplary compositions for the various components of golf balls having structures in accordance with the present disclosure. As indicated in Table 5, Examples 1 and 2 and Comparative Examples 1 and 2 include 24 mm cores, whereas Examples 3 and 4 and Comparative Examples 3 and 4 include 28 mm cores. In addition, Examples 1 and 3 correspond to an embodiment having a configuration like that shown in FIG. 1, in which the enclosing layer encloses the core, but is disposed radially inward of the intermediate layer, as indicated in the "Enclosing Layer" portion of Table 5. Examples 2 and 4 correspond to an embodiment having a configuration like that shown in FIG. 2, in which the enclosing layer is disposed radially outward of the intermediate layer, as also indicated in the "Enclosing Layer" portion of Table 5.

As indicated in Table 5, it will be noted that the cores of Examples 1 and 3 maintains a higher COR when the ball is exposed to cool weather than the cores of Comparative Examples 1 and 3, which do not include any insulating, enclosing layer. Thus, as indicated in Table 5, the COR of a multilayer solid golf ball with enclosing layer 40 will drop slower in a cold environment than the conventional multilayer golf ball without the enclosing layer, demonstrating that the multilayer solid golf ball 100 of the present invention has the higher COR in a cold environment thereby providing a longer flying distance and a better ball control.

Examples 2 and 4 in Table 5 are balls configured according to the embodiment shown in FIG. 2. When compared with Comparative Examples 2 and 4, the data for Examples 2 and 4 demonstrates that the COR of ball 200 with enclosing layer 80 will drop slower in a cold environment than a conventional multilayer solid golf ball without the enclosing layer, such as Comparative Examples 2 and 4. Thus, ball 200 will maintain a higher COR in a cold environment, proving a longer flying distance and better ball control.

Table 5 includes calculated data, for each example, of the ratio between the ball COR after exposure to 0° C. for 30 minutes to the original COR at 24° C. As shown in Table 5, the ratio for each of Examples 1-4 is 0.944 (94.4 percent) or greater. Thus, a ball having an insulating layer according to the present disclosure has a COR after exposure to 0° C. for 30 minutes that is at least 94.4 percent of the original COR at 24° C. In contrast, for each of Comparative Examples 1-4 (without an insulating layer), the ratio is less than 0.944.

TABLE 1

| Core | |
|---|---|
| Resin Blend | A |
| HPF 2000* | 100 |

*HPF 2000 is trade name of ionomeric resin by E. I. DuPont de Nemours and Company

TABLE 2

| Intermediate Layer | | |
|---|---|---|
| Rubber Compound | B | C |
| TAIPOL BR0150* | 100 | 100 |
| Zinc diacrylate | 28 | 26 |
| Zinc oxide | 6 | 4.5 |
| Barium sulfate | 39.5 | 32 |
| Peroxide | 1 | 1 |

*TAIPOL BR0150 is the trade name of rubber by Taiwan Synthetic Rubber Corp.

TABLE 3

| Enclosing Layer | | |
|---|---|---|
| | D | E |
| Methyl ethyl ketone | 31 | 33 |
| Methyl cyclohexane | 57 | 58 |
| ethylene vinyl acetate | 12 | 9 |

TABLE 4

| Cover | |
|---|---|
| Resin Blend | F |
| Surlyn ® 8940* | 50 |
| Surlyn ® 9910* | 50 |

*Surlyn ® 8940 and Surlyn ® 9910 are trade names of ionomeric resin by E. I. DuPont de Nemours and Company

TABLE 5

| | Example | | | | Comparative Example | | | |
|---|---|---|---|---|---|---|---|---|
| | 1 | 2 | 3 | 4 | 1 | 2 | 3 | 4 |
| Core | | | | | | | | |
| Blend | A | A | A | A | A | A | A | A |
| Diameter (mm) | 24 | 24 | 28 | 28 | 24 | 24 | 28 | 28 |
| Weight (g) | 7.0 | 7.0 | 11.1 | 11.1 | 7.0 | 7.0 | 11.1 | 11.1 |
| Specific gravity | 0.96 | 0.96 | 0.96 | 0.96 | 0.96 | 0.96 | 0.96 | 0.96 |
| Surface Shore D hardness | 53 | 53 | 53 | 53 | 53 | 53 | 53 | 53 |
| Compression, 10-130 kg (mm) | 2.6 | 2.6 | 2.6 | 2.6 | 2.6 | 2.6 | 2.6 | 2.6 |
| Core COR* | 0.8471 | 0.8474 | 0.8459 | 0.8461 | 0.8472 | 0.8474 | 0.8460 | 0.8459 |
| Intermediate Layer | | | | | | | | |
| Compound | C | C | B | B | C | C | B | B |
| Diameter (mm)** | 39.3 | 39.3 | 39.3 | 39.3 | 39.3 | 39.3 | 39.3 | 39.3 |
| Weight (g)** | 36.8 | 36.8 | 36.8 | 36.8 | 36.8 | 36.8 | 36.8 | 36.8 |
| Specific gravity (g/cm$^3$)** | 1.17 | 1.17 | 1.17 | 1.17 | 1.17 | 1.17 | 1.17 | 1.17 |
| Surface Shore D hardness | 41 | 41 | 43 | 43 | 41 | 41 | 43 | 43 |
| Compression, 10-130 kg (mm)** | 3.3 | 3.3 | 3.2 | 3.2 | 3.3 | 3.3 | 3.2 | 3.2 |
| Enclosing Layer | | | | | | | | |
| Blend | E | E | D | D | None | None | None | None |
| Thickness (mm) | 0.02 | 0.02 | 0.02 | 0.02 | — | — | — | — |
| Thermal conductivity (W/m-K)*** | 0.12 | 0.12 | 0.10 | 0.10 | — | — | — | — |
| Enclosing core | Yes | — | Yes | — | — | — | — | — |
| Enclosing intermediate layer | — | Yes | — | Yes | — | — | — | — |
| Cover | | | | | | | | |
| Blend | F | F | F | F | F | F | F | F |
| Thickness | 1.71 | 1.71 | 1.71 | 1.71 | 1.7 | 1.7 | 1.74 | 1.74 |
| Specific gravity | 0.99 | 0.99 | 0.99 | 0.99 | 0.99 | 0.99 | 0.99 | 0.99 |
| Surface Shore D hardness | 69 | 69 | 69 | 69 | 69 | 69 | 69 | 69 |
| Ball | | | | | | | | |
| Weight (g) | 45.4 | 45.4 | 45.4 | 45.4 | 45.4 | 45.4 | 45.4 | 45.4 |
| Diameter (mm) | 42.7 | 42.7 | 42.7 | 42.7 | 42.7 | 42.7 | 42.7 | 42.7 |
| Compression, 10-130 kg (mm) | 2.8 | 2.8 | 2.9 | 2.9 | 2.8 | 2.8 | 2.9 | 2.9 |
| Ball COR* | | | | | | | | |
| 24° C. | 0.8101 | 0.8105 | 0.8123 | 0.8124 | 0.8112 | 0.8110 | 0.8128 | 0.8132 |
| 0° C. × 10 mins | 0.7828 | 0.7825 | 0.7871 | 0.7830 | 0.7751 | 0.7781 | 0.7795 | 0.7804 |
| 0° C. × 20 mins | 0.7717 | 0.7713 | 0.7789 | 0.7748 | 0.7648 | 0.7683 | 0.7712 | 0.7720 |

TABLE 5-continued

| | Example | | | | Comparative Example | | | |
|---|---|---|---|---|---|---|---|---|
| | 1 | 2 | 3 | 4 | 1 | 2 | 3 | 4 |
| 0° C. × 30 mins | 0.7663 | 0.7660 | 0.7736 | 0.7685 | 0.7601 | 0.7635 | 0.7667 | 0.7670 |
| 30 min COR/24° C. COR | 0.946 | 0.945 | 0.952 | 0.946 | 0.937 | 0.941 | 0.943 | 0.943 |

*For the COR test of the present invention, the initial velocity is 40 m/sec.

**Value of core + intermediate layer + enclosing layer.

***Thermal conductivity is measured by a thermal conductivity analyzer, Hot Disk TPS 2500 with thin film module, commercially available from Hot Disk AB company, Sweden.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A multilayer solid golf ball comprising:

a core formed from a highly neutralized polymer;

a cover surrounding the core; and an enclosing layer comprising ethylene vinyl acetate copolymer disposed between the core and the cover, the enclosing layer having a thickness of 0.005 mm to 0.02 mm, and a thermal conductivity of 0.12 W/m-K or less.

2. The ball of claim 1, wherein the ball has a first ball coefficient of restitution at a temperature of 24° C. and a second ball coefficient of restitution when the ball is exposed to air of 0° C. for 30 minutes, wherein the second ball coefficient of restitution is at least 94.4 percent of the first ball coefficient of restitution.

3. The ball of claim 1, wherein the core has a coefficient of restitution greater than 0.75 at a temperature of 24° C.

4. The ball of claim 3, wherein the coefficient of restitution of the core is greater than 0.8.

5. The ball of claim 1, wherein the enclosing layer has a thermal conductivity that is lower than the thermal conductivity of the cover.

6. The ball of claim 1, wherein the ball includes an intermediate layer disposed between the core and the cover, wherein the enclosing layer has a thermal conductivity that is lower than the thermal conductivity of the intermediate layer.

7. The ball of claim 1, wherein the core has a surface Shore D hardness of about 30 to about 60.

8. The ball of claim 1, wherein the enclosing layer has a thickness of 0.02 mm.

9. A multilayer solid golf ball comprising:

a core having a coefficient of restitution greater than 0.75 at a temperature of 24° C., wherein the core is formed from a highly neutralized polymer;

a cover surrounding the core; and an insulating layer comprising ethylene vinyl acetate copolymer disposed between the core and the cover, the insulating layer having a thickness of 0.005 mm to 0.02 mm, and having a thermal conductivity that is lower than the thermal conductivity of the cover.

10. The ball of claim 9, wherein the insulating layer has a thermal conductivity of 0.12 W/m-K or less.

11. The ball of claim 9, wherein the insulating layer has a thickness of 0.02 mm.

12. The ball of claim 9, wherein the coefficient of restitution of the core is greater than 0.8.

13. The ball of claim 9, wherein the ball has a first ball coefficient of restitution at a temperature of 24° C. and a second ball coefficient of restitution when the ball is exposed to air of 0° C. for 30 minutes, wherein the second ball coefficient of restitution is at least 94.4 percent of the first ball coefficient of restitution.

14. The ball of claim 9, wherein the ball includes an intermediate layer disposed between the core and the cover, wherein the insulating layer has a thermal conductivity that is lower than the thermal conductivity of the intermediate layer.

15. The ball of claim 9, wherein the insulating layer is formed of a substantially homogeneous material.

16. The ball of claim 9, wherein the insulating layer has an inner surface, and the core has an outer surface contacting the inner surface of the enclosing layer.

* * * * *